US005237585A

United States Patent [19]

Stenkvist

[11] Patent Number: 5,237,585

[45] Date of Patent: Aug. 17, 1993

[54] DIRECT-CURRENT ARC FURNACE HAVING CIRCUMFERENTIAL ZONES OF VARYING CONDUCTIVITY

[75] Inventor: Sven-Einar Stenkvist, Brugg, Switzerland

[73] Assignee: Asea Brown Boveri Ltd., Baden, Switzerland

[21] Appl. No.: 748,866

[22] Filed: Aug. 23, 1991

[30] Foreign Application Priority Data

Sep. 3, 1990 [EP] European Pat. Off. ..... 90116866.6

[51] Int. Cl.[5] ..... H05B 7/06; F27D 11/10

[52] U.S. Cl. ..... 373/72; 373/60; 373/107

[58] Field of Search ..... 373/107, 108, 60, 72; 432/252

[56] References Cited

U.S. PATENT DOCUMENTS

| | | | |
|---|---|---|---|
| 4,371,334 | 2/1983 | Van Laar | 432/252 |
| 4,541,099 | 9/1985 | Rappinger et al. | 373/72 |
| 4,550,413 | 10/1985 | Lassander et al. | 373/108 |
| 4,577,326 | 3/1986 | Bergman et al. | 373/103 |
| 4,637,033 | 1/1987 | Buhler | 373/72 |
| 4,692,930 | 9/1987 | Radke et al. | 373/72 |
| 4,805,186 | 2/1989 | Janiak et al. | 373/79 |
| 5,052,018 | 9/1991 | Meredith | 373/72 |
| 5,134,628 | 7/1992 | Stenkvist | 373/72 |
| 5,173,920 | 12/1992 | Bochsler et al. | 373/72 |

FOREIGN PATENT DOCUMENTS

| | | |
|---|---|---|
| 0217208 | 4/1987 | European Pat. Off. . |
| 269465 | 7/1987 | European Pat. Off. . |
| 0258101 | 3/1988 | European Pat. Off. . |
| 0269465 | 6/1988 | European Pat. Off. . |

*Primary Examiner*—Bruce A. Reynolds
*Assistant Examiner*—John A. Jeffery
*Attorney, Agent, or Firm*—Oblon, Spivak, McClelland, Maier & Neustadt

[57] ABSTRACT

A direct current arc furnace has a furnace vessel which is surrounded by a metal shell having at least one electrode connected as a cathode, and at least one bottom contact. The bottom of the furnace consists of a lining layer which possesses electrically conducting bricks or the like, which lining layer lies on a contact plate covering most of the bottom. The contact plate forms the bottom contact connected as the anode and lies on a bottom plate. The bottom plate is equipped with a plurality of connection fittings which pass through openings in the bottom plate and are connected via electric wires to a current supplying device provided next to the furnace. For the internal deflection of the arc, at least one section of the lining layer is composed of a material which possesses a lower electrical conductivity than the lining layer in another section which is circumferentially spaced from the one section so as to form circumferentially spaced zones of varying conductivity.

11 Claims, 2 Drawing Sheets

FIG.1
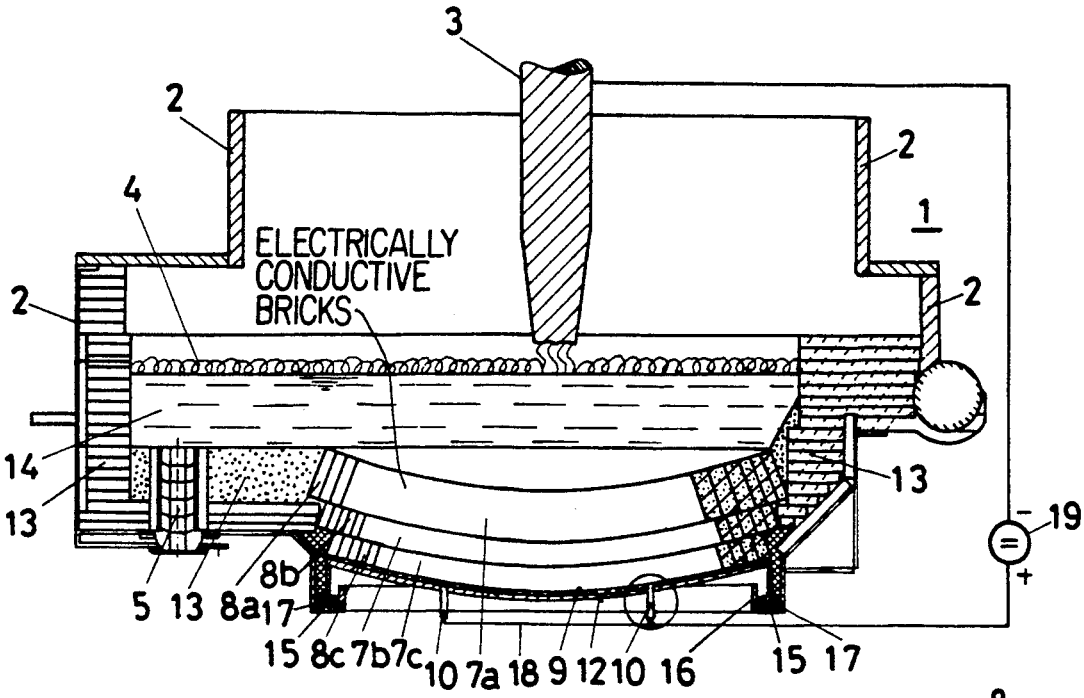
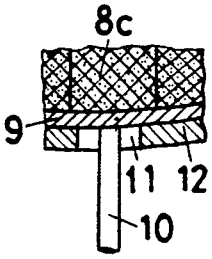
FIG.1a
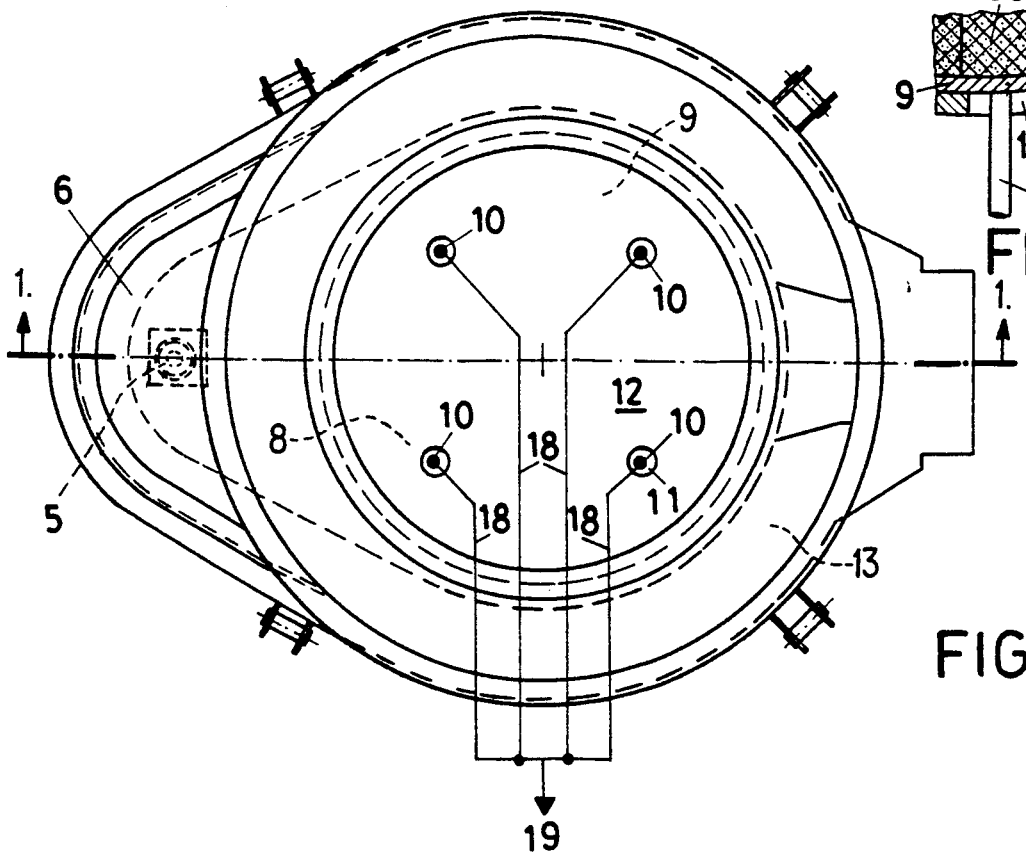
FIG.2

DIRECT-CURRENT ARC FURNACE HAVING CIRCUMFERENTIAL ZONES OF VARYING CONDUCTIVITY

TECHNICAL FIELD

The invention relates to a direct-current arc furnace having a furnace vessel which is surrounded by a metal shell, having at least one electrode connected as the cathode, and at least one bottom contact, the bottom of the furnace consisting of one or more lining layers which possess electrically conducting bricks or other equally acting inserts, which lining layer(s) lie on a contact plate covering most of the bottom, which contact plate forms the bottom contact connected as the anode and lies on a bottom plate, said contact plate is equipped with a plurality of connection fittings which pass through openings in the bottom plate and are connected via electric lines to a current-supplying device provided next to the furnace vessel.

The invention makes reference, in this connection, to a prior art as revealed, for example, by U.S. Pat. No. 4,550,413.

TECHNOLOGICAL BACKGROUND AND PRIOR ART

In the case of high-capacity direct-current arc furnaces, the high currents flowing in the current lead-in and lead-off lines give rise to deflections of the arc. The arc does not burn vertically. Rather, the arc is directed towards the furnace wall and gives rise to overheating there.

As a result of a particular arrangement of the current feed and discharge lines underneath and next to the furnace vessel, a "centering" of the arc can be obtained. Thus, in U.S. Pat. No. 4,550,413 and U.S. Pat. No. 4,577,326 it is proposed to lay these lines in such a way that the magnetic fields caused by the flowing direct current act on the arc symmetrically. These measures are expensive, however, and increase not only the cost but also the space requirement of the furnace. Another solution consists in making the electrode together with the electrode support apparatus horizontally displaceable relative to the furnace vessel in order thereby to compensate for asymmetries in the current feed and discharge. This measure is also very expensive, because sufficient space has to be provided in the furnace cover for the movement path of the electrode.

Whereas the current feed gives rise to undesired deflection of the arc, it may well be the case in practice that the arc is to be deflected intentionally in one direction or another in order, for example in the region of an eccentric bottom taphole or in the case of furnaces with continuous charging, to produce more heat in said regions. This would only be possible by horizontal movement of the electrode relative to the furnace vessel, which would however be very expensive.

BRIEF DESCRIPTION OF THE INVENTION

The object on which the invention is based is to provide a direct-current arc furnace in which an intentional deflection and/or symmetrization of the arc is achieved.

This object is achieved according to the invention by the fact that, for the intentional deflection of the arc, one of more circumferential sections of the lining layer are composed of a material which possesses a lower specific electrical conductivity than the lining layer in the remaining section.

Preferably, in this, connection, the lining layer is composed, in its circumferential section facing the current-supplying device, at least partly of a material which possesses a lower specific electrical conductivity than the lining layer in the remaining section.

In the case of arc furnaces having an eccentric bottom taphole, it is expedient if the lining layer in the circumferential region of the bottom taphole possesses a lower electrical conductivity than in the remaining region so as to avoid a deflection of the arc. In this way, the arc is deflected towards the bottom taphole and consequently more heat is produced in the melt at that point.

In the case of arc furnaces for the continuous charging of spongy iron or scrap, a deflection of the arc can be brought about by the fact that the lining layer in the circumferential region being charged possesses a lower specific electrical conductivity than in the remaining region. This gives rise, analogously to that mentioned above, to deflection of the arc towards the charging and thus to an increased heat supply.

The advantage of the invention is to be seen particularly in the fact that, without expensive line arrangement underneath or next to the furnace vessel or movement of the electrode for the intentional deflection of the arc, in which case this deflection gives rise, if required, to symmetrization or can give rise purposely a deflection of the arc in a predetermined direction. Since the lining layer has to be replaced periodically anyway, existing arc furnaces can also be fitted with the lining layer according to the invention.

Embodiments of the invention and the advantages obtainable therewith are explained in greater detail below with reference to the drawing.

BRIEF DESCRIPTION OF THE DRAWING

In the drawing, an exemplary embodiment of the invention is illustrated diagrammatically, wherein:

FIG. 1 shows, in longitudinal section, along section line 1—1 of FIG. 2, an exemplary embodiment of a direct-current arc furnace having an eccentric bottom taphole;

FIG. 1*a* shows a detail of FIG. 1, illustrating the electrical connection at the furnace bottom;

FIG. 2 shows a bottom plan view of the furnace vessel bottom of the arc furnace according to FIG. 1;

METHODS FOR CARRYING OUT THE INVENTION

Figure 3:
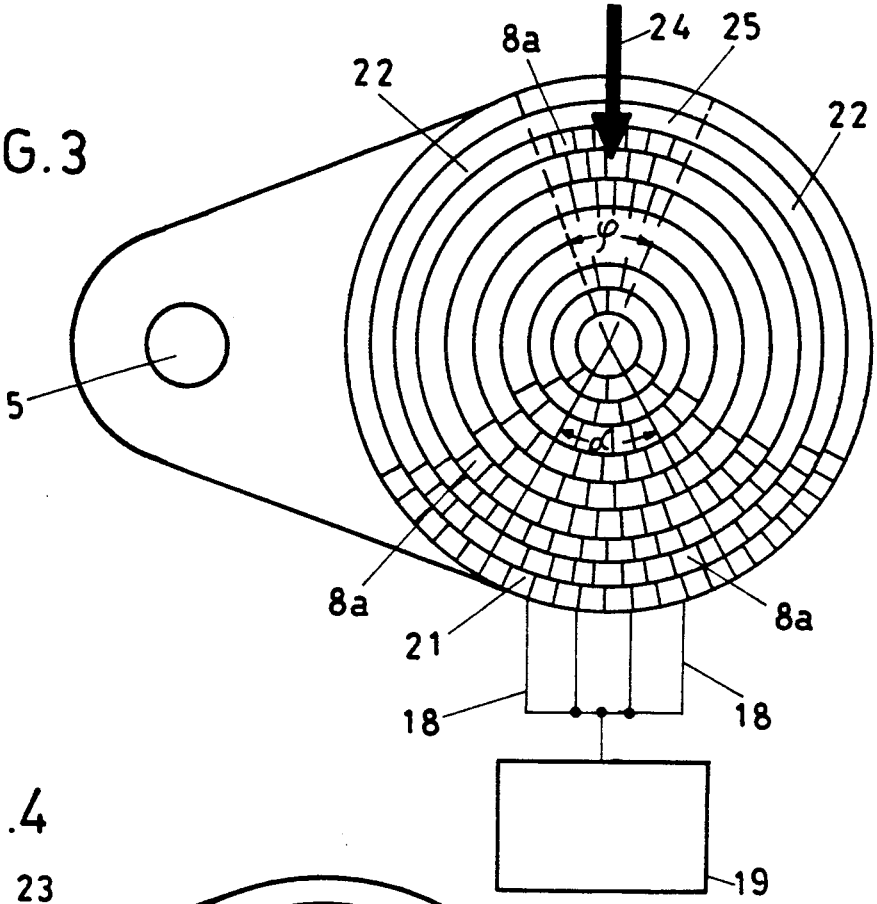
FIG. 3 shows a plan view of the lining layer of the direct-current arc furnace according to FIG. 1, having additional arrangements for the increased heat supply in the region of the bottom taphole.

A direct-current arc furnace according to FIG. 1 possesses a furnace vessel 1 which is equipped with a shell 2 made of metal. The furnace cover and the electrode support apparatus have been omitted. In the exemplary embodiment, the furnace possesses only one solid electrode 3 connected as the cathode, but this number may also be two, three or more. Underneath the electrode 3, an electrode spot, i.e. a slag-free surface of the melt 4, is obtained in the usual way. The furnace has a tapping device in the form of an eccentric bottom taphole 5 in a bay-like projection 6 of the furnace vessel. A bottom contact is fixed in the furnace base. The bottom contact consists, in this example, of three lining layers 7*a*, 7*b* and 7*c* (lacuna) graphite or graphite-containing bricks 8*a*, 8*b*, 8*c* which lie on a spherical cap-shaped contact plate 9. Connection fittings 10 (FIG. 1*a*) on the contact plate 9 project downwards to the outside through openings 11 in the vessel bottom 12.

Adjoining the bottom lining layer towards the outside is the conventional furnace brick lining 13. The vessel bottom 12 can be equipped with a cooling means (not shown) in order to keep it at as low a temperature as possible. The bricks 8*a*, 8*b* and 8*c* of the lining layers 7*a*, 7*b* and 7*c* serve as current conductors between the melt 14 and the contact plate 9.

To this extent, the direct-current arc furnace corresponds to the prior art and is described in detail, for example, in detail in U.S. Pat. No. 4,228,314, DE Patent Specification 30 22 566, GB-A 21 33 125 and also DE-A-32 41 978, the first-mentioned documents relating to conventional arc furnaces and the last-mentioned to arc furnaces having an eccentric bottom taphole.

The shell 2 of the furnace vessel (lacuna) is drawn radially inwards and forms an inwardly projecting collar 15, the end 16 of which is bent upwards. The bottom plate 12 projects beyond the collar 15 in the radial direction. A ring 17 made of insulating material is arranged in the overlapping region. In this way, the entire bottom part of the furnace is supported in an electrically insulating manner on the collar 15. The bottom part of the furnace virtually floats in the furnace vessel 1. At the same time, electrical insulation between furnace shell 2 and bottom plate 12 and thus the bottom contact is brought about via the insulating material.

The distribution of the connection fittings to the contact plate 9 is visible in the plan view of the underside of the furnace vessel 1 according to FIG. 2. Four fittings 10 are distributed regularly over the bottom, and the high-current lines 18 to the current-supplying device 19 of the arc furnace can be seen.

The plan view of the top lining layer 7*a* according to FIG. 3 shows the distribution, according to the invention, of the bricks 8*a*: in a first sector 21 with a circumferential opening angle $\alpha$ typically over 45° to 90° which opens symmetrically towards the current-supplying device 19, the bricks 8*a*, 8*b* and/or 8*c* of the lining layers 7*a*, 7*b* and 7*c* respectively are composed of a material of lower carbon content than the bricks of the second sector 22, which have a carbon content typically of 10–20% by weight of carbon. The electrical conductivity in the first sector 21 is, accordingly, lower than outside this area.

Without this measure and a line arrangement as depicted in FIG. 2 (in FIG. 1 the line arrangement and the position of the current-supplying device 19 are indicated merely diagrammatically), the arc would be deflected in a direction away from the current-supplying device 19 under the influence of the current flowing in the electrode 3 and the high-current lines 18. In contrast, with the composition according to the invention of the lining layer(s), the electric/magnetic center of the bottom contact—considered on its own—is displaced from the geometric center. In this way, the current distribution in the melt is influenced such that more current enters the latter in the region of the second sector 22 and thus compensatively superposes the deflecting constant field arising from the high-current lines 18. The consequence of this is a deflection-free arc functioning.

Both the "normal-conducting" and the "weaker-conducting" bricks are conventional and are offered by relevant firms in a wide variety of specifications. In addition, however, bricks may also be used which possess electrical conductors other than graphite, for example those in which the electrical conductivity is determined by the content of borides. Use may also be made of bricks which consist of an essentially nonconducting core which is totally or only partly enveloped by a metal envelope.

Instead of sectors 21, 22 of different conductivity, said lining layers can also be constructed to be different in their electrical conductivity in another way, for example by scattering, in the section of the lining layer facing the current-supplying device (12), bricks of lower conductivity or nonconducting bricks in the lining layer(s).

It could be considered disadvantageous that the proposed measures do not result in complete elimination of deflection in the case of a new installation, for example because the opening angle $\alpha$ has been chosen too small or too large, or the conductivity of the lining layer(s) has been wrongly dimensioned in the first sector 21. However, since lining layers have to be replaced regularly anyway, the trial phase is comparatively short as compared with the service life of the furnace and, accordingly, impairs the furnace operation and its efficiency only slightly.

Figure 4:
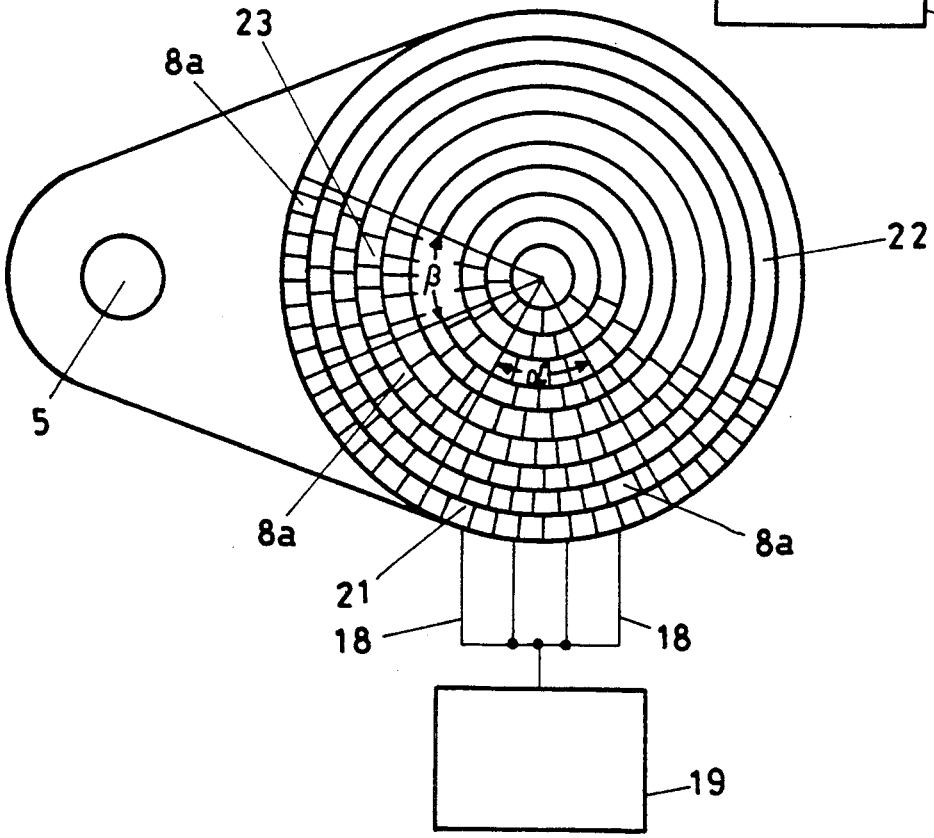
FIG. 4 shows a plan view of the lining layer of the direct-current arc furnace according to FIG. 1, having additional arrangements for the increased heat supply in the region of the charging.

In the case of arc furnaces having an eccentric bottom taphole or in the case of furnaces in which scrap or spongy iron is charged continuously, the temperature of the melt in the region of the bottom taphole or charging is lower than in the remaining region of the melt. By chosing sections of the lining layer with different electrical conductivity, it is also possible to achieve an intentional deflection of the arc for special purposes of this type, so as to (lacuna) given zones of the melt:

In FIG. 4, in addition to the sector 21 a second sector 23 is provided with bricks of poorer electrical conductivity, which sector opens symmetrically towards the bottom taphole 5 with a circumferential opening angle $\beta$. For the dimensioning of the opening angle $\beta$ and the conductivity of the bricks, the same considerations apply as mentioned hereinabove in connection with the symmetrization. Of course, the intentional deflection can also be employed by itself as a result of the structure of the sector 23 if, for example, an arrangement of the lines as in the prior art according to U.S. Pat. No. 4,577,326 or U.S. Pat. No. 4,550,413 is used.

In FIG. 3, a third possibility for influencing the arc is furthermore indicated. It applies to arc furnaces using continuous charging with spongy-iron pellets or scrap. In the case of charging opposite the current-supplying device 19—indicated by the arrow 24—a deflection in the direction of the charge is achieved by the fact that, in a sector 25 with the opening angle $\psi$, the material of the lining layer possesses a lower conductivity than in the section(s) 22. In this case, too, this measure, if necessary, can be taken on its own.

I claim:

1. Direct-current arc furnace having a furnace vessel which is surrounded by a metal shell, having at least one electrode connected as the cathode, and at least one bottom contact, the bottom of the furnace comprising a lining layer which possesses electrically conducting elements, which lining layer lies on a contact plate covering most of the bottom, which contact plate forms the bottom contact connected as the anode and lies on a bottom plate, wherein said contact plate is equipped with a plurality of connection fittings which pass through openings in the bottom plate and are connected via electric lines to a current-supplying device provided next to the furnace vessel, and wherein for the internal deflection of the arc, at least one section of the lining layer is composed of a material which possesses a lower electrical conductivity than the lining layer in another section which is circumferentially spaced from said at least one section so as to form circumferentially spaced zones of varying conductivity.

2. Arc furnace according to claim 1, wherein said at least one section is at a circumferential position which faces the current supplying device.

3. Arc furnace according to claim 2, wherein said at least one section has a circumferential opening angle of between 45° and 90°.

4. Arc furnace according to claim 2, wherein said at least one section has a electrical conductivity which is at least 25% lower than the electrical conductivity of said another section.

5. Arc furnace according to claim 2, including an eccentric bottom tap hole in the bottom of the furnace, and also including a further section of the lining layer composed of a material which possesses a lower electrical conductivity than the lining layer in said another section, wherein the further section is at a circumferential position which faces the bottom tap hole.

6. Arc furnace according to claim 2, including means for continuous charging of spongy iron or scrap into the furnace, also including a further section of the lining layer which is composed of a material which possesses a lower electrical conductivity than the lining layer of said another section, wherein said further section is at a circumferential position which faces the means for continuous charging.

7. Arc furnace according to claim 2, wherein said at least one section has a circumferential opening angle of between 20° and 180°.

8. Arc furnace according to claim 1, including an eccentric bottom tap hole in the bottom of the furnace, wherein said at least one section is at a circumferential position which faces the bottom tap hole.

9. Arc furnace according to claim 1, including means for continuous charging spongy iron or scrap into the furnace, wherein said at least one section of the lining layer is at a circumferential position which faces the means for continuous charging.

10. Arc furnace according to any one of claims 1 and 2–6, wherein the lining layer is composed of at least one course of bricks which contain one from the group consisting of graphite, borides and metal as the electrical conductor.

11. Arc furnace according to any one of claims 1 or 2–6, wherein the lining layer is composed of one or more courses of bricks which are enveloped in one from the group consisting of graphite, borides and metal as the electrical conductor.

* * * * *

UNITED STATES PATENT AND TRADEMARK OFFICE

CERTIFICATE OF CORRECTION

PATENT NO. : 5,237,585

DATED : August 17, 1993

INVENTOR(S) : Sven-Einar Stenkvist

It is certified that error appears in the above-indentified patent and that said Letters Patent is hereby corrected as shown below:

On the title page, item [54] and column 1, lines 2-4, the title should read --DIRECT-CURRENT ELECTRIC ARC FURNACE HAVING CIRCUMFERENTIAL ZONES OF VARYING CONDUCTIVITY--

Signed and Sealed this

Eighth Day of March, 1994

Bruce Lehman

*Attest:*

BRUCE LEHMAN

*Attesting Officer*

*Commissioner of Patents and Trademarks*